United States Patent [19]

Fukuda et al.

[11] Patent Number: 4,541,326

[45] Date of Patent: Sep. 17, 1985

[54] DISCHARGE DIRECTION CONTROL DEVICE FOR AIR CONDITIONER

[75] Inventors: Katsumi Fukuda, Shiga; Masaharu Ebihara, Kusatsu; Tadahiko Hayakumo, Shiga; Tsunehiko Todoroki, Kusatsu, all of Japan

[73] Assignee: Matsushita Electric Industrial Co., Ltd., Kadoma, Japan

[21] Appl. No.: 626,122

[22] Filed: Jun. 29, 1984

[30] Foreign Application Priority Data

Jul. 1, 1983 [JP] Japan ..... 58-120554
Jul. 1, 1983 [JP] Japan ..... 58-120552

[51] Int. Cl.[4] ..... F24F 7/00
[52] U.S. Cl. ..... 98/40.25; 236/49
[58] Field of Search ..... 98/40 VT; 236/49, 101 R, 236/101 D, 101 E

[56] References Cited

U.S. PATENT DOCUMENTS 2,057,494 10/1936 Leigh ..... 98/40 VT
2,117,529 5/1938 Wile et al. ..... 98/40 VT
2,698,570 1/1955 Feinberg ..... 98/40 VT
4,227,646 10/1980 Hart et al. ..... 236/101 D X

FOREIGN PATENT DOCUMENTS 55-158438 12/1980 Japan ..... 98/40 VT

*Primary Examiner*—Harold Joyce
*Attorney, Agent, or Firm*—Wenderoth, Lind & Ponack

[57] ABSTRACT

The disclosure is directed to an air flow direction control device for an air conditioner such as a room air conditioner, which includes a discharge direction changing blade for controlling air flow discharge direction, a shape memory alloy or SMA member for rotating the blade in one direction and a bias spring for urging the blade in the other direction, a lever arm urged to contact a shaft of the blade and a releasing mechanism for releasing the lever arm from its contact with the shaft. According to the present invention, the blasted air temperature detecting unit, motor for driving the blade, control unit for controlling and driving the motor, etc. conventionally required may be dispensed with for reduction in cost, and furthermore, it becomes possible to properly alter the air flow discharging direction according to the temperatures of the blasted air.

5 Claims, 6 Drawing Figures

DISCHARGE DIRECTION CONTROL DEVICE FOR AIR CONDITIONER

BACKGROUND OF THE INVENTION

The present invention generally relates to an air conditioner and more particularly, to an air flow discharge direction control device for an air conditioner, e.g. a room air conditioner, which employs a shape memory alloy member (referred to as an SMA member hereinafter) for a driving source of a discharge direction changing blade.

Conventionally, as an air flow discharge direction control device for an air conditioner, it has been so arranged that the discharge direction changing blade is driven by a motor and the like through control according to temperatures of blasted air, with change-over between an automatic operation and a manual operation being effected through on/off of a power source to be applied to the motor.

The known arrangement as described above, however, has such a disadvantage that a temperature detecting means for detecting the temperature of the blasted air and an expensive motor must be employed for the operations, thus resulting in an increase of cost involved.

SUMMARY OF THE INVENTION

Accordingly, an essential object of the present invention is to provide a discharge direction control device for an air conditioner, which is capable of readily driving and controlling an air flow discharge direction changing blade through a simple construction, and at a consequent low cost.

Another important object of the present invention is to provide a discharge direction control device of the above described type, which is stable in functioning at a high reliability, and can be readily incorporated into air conditioners of various types.

In accomplishing these and other objects, according to one preferred embodiment of the present invention, there is provided a discharge direction control device for a room air conditioner, which includes a discharge direction changing blade for controlling the discharge direction of air flow upwardly and downwardly, a coil-like shape memory alloy member or SMA member for rotating the discharge direction changing blade in one direction, and a bias spring member for urging the discharge direction changing blade to rotate in the other direction which are provided at an air blast opening of the air conditioner arranged to blast heat-exchanged air therefrom, a lever arm member urged to contact a shaft at one end of the discharge direction changing blade, and a releasing mechanism for releasing the lever arm member from the contact thereof with said shaft, and also a protecting cover for protecting the coil-like SMA member, with a large number of ventilation holes being formed in said protecting cover.

By the arrangement according to the present invention as described above, during contact of the lever arm with the shaft, driving of the discharge direction changing blade by the coil-like SMA member is obstructed, while, upon spacing of the lever arm from the shaft, the discharge direction changing blade is automatically driven for rotation by the expansion or contraction of the SMA member. Moreover, since the SMA member is protected by the protecting cover so as not to be touched from outside, proper air mount and air temperature are applied at stable rates to the SMA member, without being affected by the lateral air flow direction alterations.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
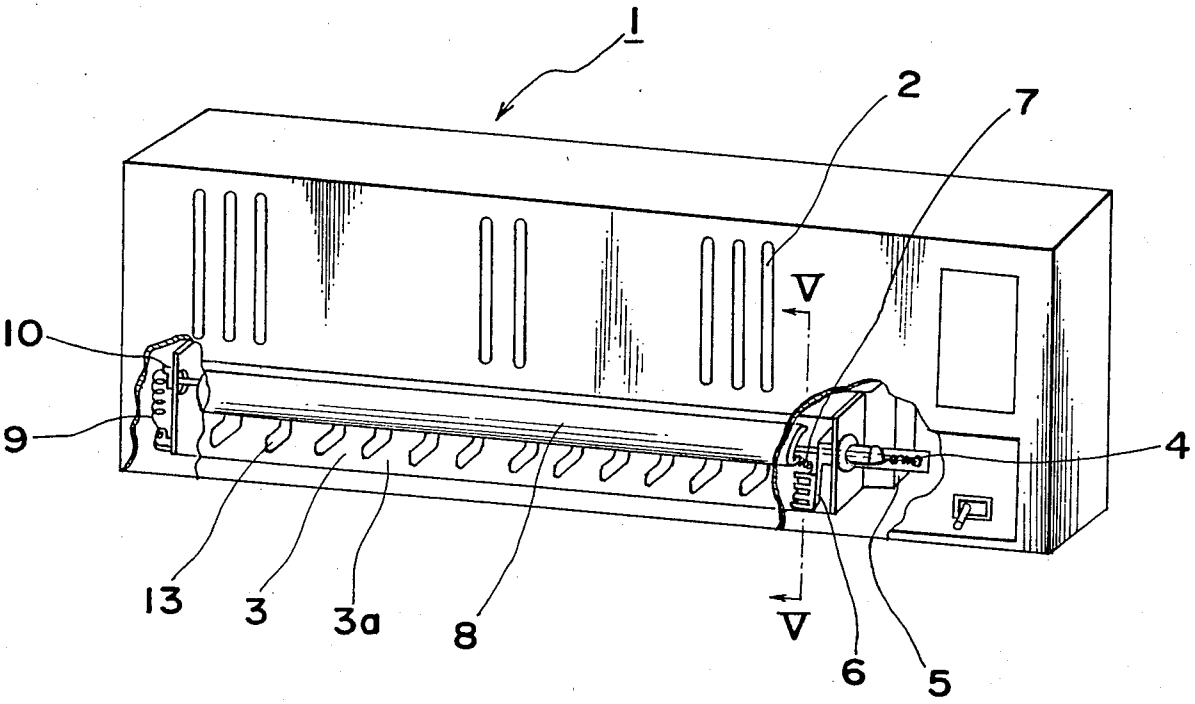
FIG. 1 is a schematic perspective view, partly broken away, of an indoor unit of a room air conditioner provided with a discharge direction control device according to one preferred embodiment of the present invention.

Before the description of the present invention proceeds, it is to be noted that like parts are designated by like reference numerals throughout the accompanying drawings.

Referring now to the drawings, there is shown in FIG. 1 an indoor unit 1 of a separate type room air conditioner to which a discharge direction control device according to the present invention may be applied. The indoor unit 1 in FIG. 1 having a rectangular cubic box-like configuration is provided on its front face with suction openings 2, and an air blast grille 3 having an air blast opening 3*a* provided with a discharge direction changing blade 8 for altering the discharge direction of air flow upwardly or downwardly, and lateral discharge direction changing vanes 13 for changing the air flow discharge direction laterally i.e. towards the left or right side.

Subsequently, with a particular reference to FIG. 2, the construction of the air blast grille 3 referred to above will be explained hereinbelow.

Figure 2:
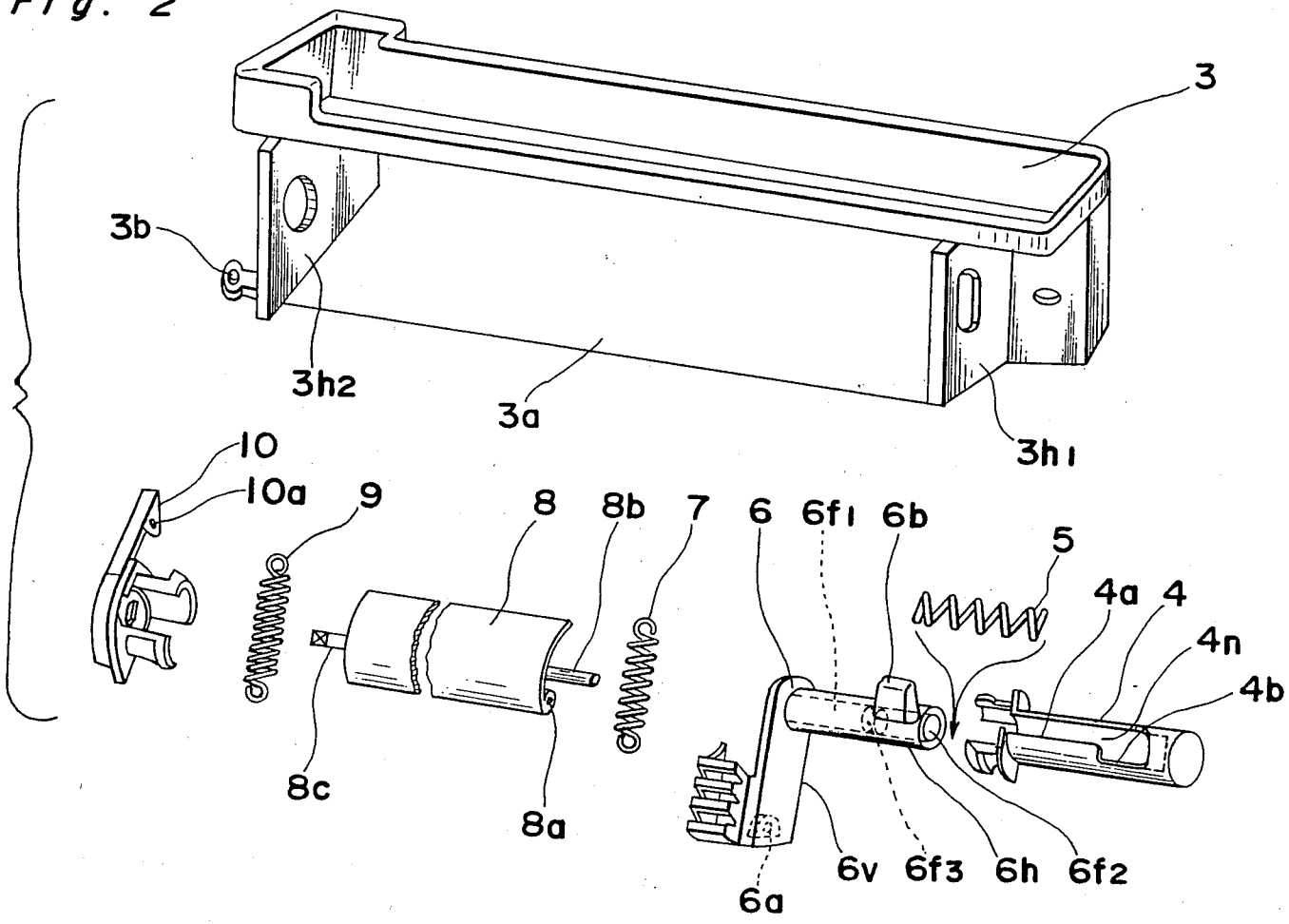
FIG. 2 is an exploded perspective view of an air blast grille portion of the air conditioner of FIG. 1.

In FIG. 2, there is shown a right side bearing 4 formed with a notched portion 4*n* including an axially extending displacing portion 4*a*, and an engaging portion 4*b* communicated with said displacing portion 4*a* and extending in an outer peripheral portion of the bearing 4. This bearing 4 is mounted on a right side wall 3*h*1 for the air blast grille 3. There is also provided a lever arm 6 which includes a hollow tube-like horizontal portion 6*h* having a central axial bore divided into a first bore 6*f*1 for receiving therein a right side shaft 8*b* of the discharge direction changing blade 8 and a second bore 6*f*2 by a partition wall 6*f*3 formed therebetween, and an operating knob 6*b* adapted to be slidably moved within the notched portion 4*n*, and a vertical portion 6*v* extending at right angles from one end of said horizontal portion 6*h*, with a coil spring 5 for a manual operation being provided between the bearing 4 and the other end of the horizontal portion 6*h* (i.e. the partition wall 6*f*3 in the second bore 6*f*2 for the horizontal portion 6*h*) of the lever arm 6. A shape memory alloy member or SMA member 7 formed into a coil-like configuration for expansion or contraction according to temperatures, has its one end engaged with a fixing hole 6*a* formed at the lower end of the vertical portion 6*v* of the lever arm 6, and the other end thereof engaged with a fixing hole 8*a* formed in one lower edge of the discharge direction changing blade 8. There is further provided a bias spring 9 in the form of a coil connected at its one end to a fixing hole 3*b* formed adjacent to a left side wall 3*h*2 of the air blast grille 3, and at the other end thereof, to a fixing hole 10*a* formed in a left side bearing 10 for receiving a left side shaft 8*c* of the discharge direction changing blade 8. This bias spring 9 normally urges the discharge direction changing blade 8 in a horizontal direction.

Figure 3:
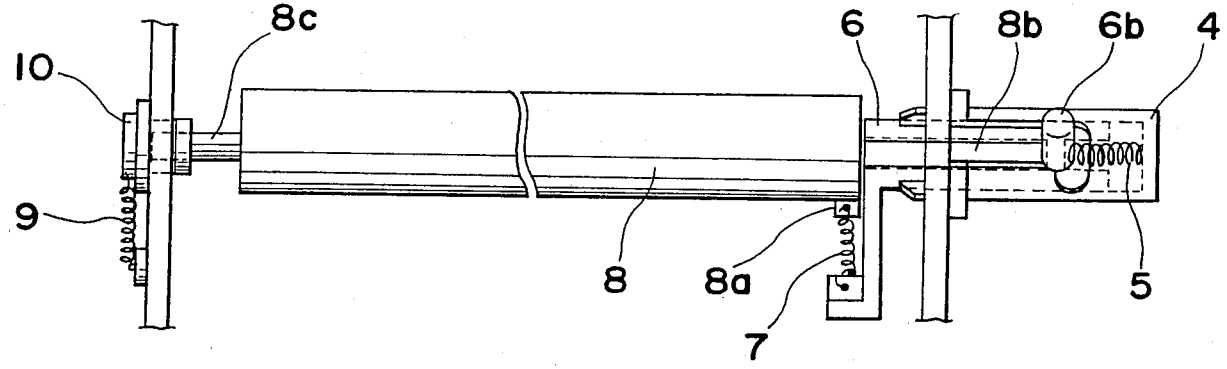
FIG. 3 is a front elevational view, showing on an enlarged scale, the discharge direction control device employed in the air conditioner of FIG. 1 under a state for a manual operation.
Figure 4:
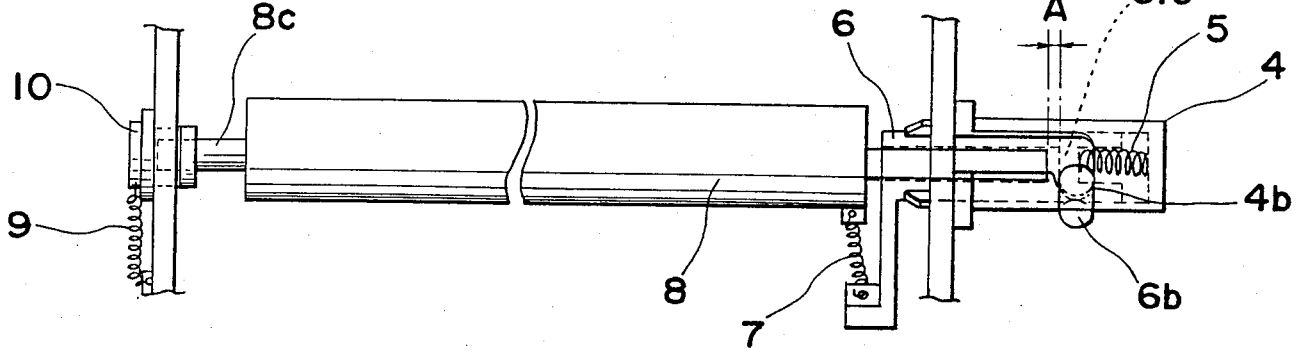
FIG. 4 is a view similar to FIG. 3, which particularly shows the discharge direction control device under a state for an automatic operation.

Referring also to FIGS. 3 and 4, functionings of the discharge direction control device through manual and automatic operations will be explained hereinbelow.

In FIG. 3 for the manual operation, the coil spring 5 in the stretched state holds the lever arm 6 pressed against the shaft face of the right side shaft 8*b* for the discharge direction changing blade 8. Accordingly, the discharge direction changing blade 8 is held stationary without being urged by the expansion and contraction of the coil-like SMA member 7 by the contact friction between the lever arm 6 and the shaft 8*b*. Under the above state, the discharge direction changing blade 8 may be rotated by a manual force larger than the frictional force.

Meanwhile, in FIG. 4 for the automatic operation, the operating lever 6*b* of the lever arm 6 is engaged with the engaging portion 4*b* of the notch 4*n* in the bearing 4 against the urging force of the coil spring 5. In the above case, the coil spring 5 is in a compressed or contracted state, with a clearance A being formed between the shaft end of the right side shaft 8*b* for the discharge direction changing blade 8 and the partition wall 6*f*3 in the first bore 6*f*1 in the horizontal portion 6*h* of the lever arm 6. Therefore, said blade 8 is rotated by the urging force of the bias spring 9 and the expanding and contracting force of the coil-like SMA member 7.

The functionings as described above will be more specifically explained hereinbelow.

Normally, the indoor unit 1 is installed at an upper portion of a wall within a room. Accordingly, it is so arranged that during cooling, a cool air flow is discharged in a horizontal direction from the air blast opening 3*a*, while during heating, a hot air flow is blasted downwardly from the air blast opening 3*a*. However, during the above heating, if the temperature of the discharged air is lower than that of a human body, it is felt to be cold. Therefore, according to the present embodiment, it is so arranged that, when the temperature of the air flow discharged from the air blast opening 3*a*reaches approximately 37° to 40° C., the SMA member 7 senses such temperature and shrinks against the elastic force of the bias spring 9, thereby to direct the discharge direction changing blade 8 downwardly, and consequently, to change the air discharge direction also downwardly. From the above state, upon lowering of the temperature of the discharged air flow down to approximately 30° to 33° C., this is detected by the SMA member 7 which is then elongated, and therefore, the discharge direction changing blade 8 is pulled by the elastic force of the bias spring 9 so as to be directed in the horizontal direction, and thus, the air flow discharged through the air blast opening 3*a* is also directed in the horizontal direction. Since such air flow at temperatures in the range of 30° to 33° C., which are lower than the temperature of a human body, is discharged in the horizontal direction at a position higher than a human head, there is no possibility that it gives a cold feeling to a human body.

Figure 5:
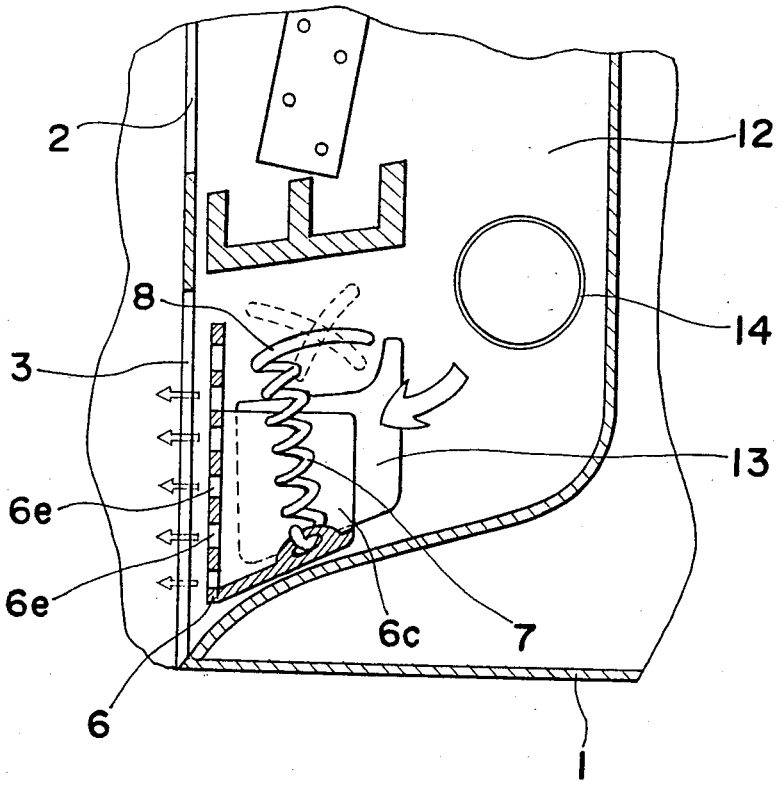
FIG. 5 is a cross section, on an enlarged scale, taken along the line V—V in FIG. 1.
Figure 6:
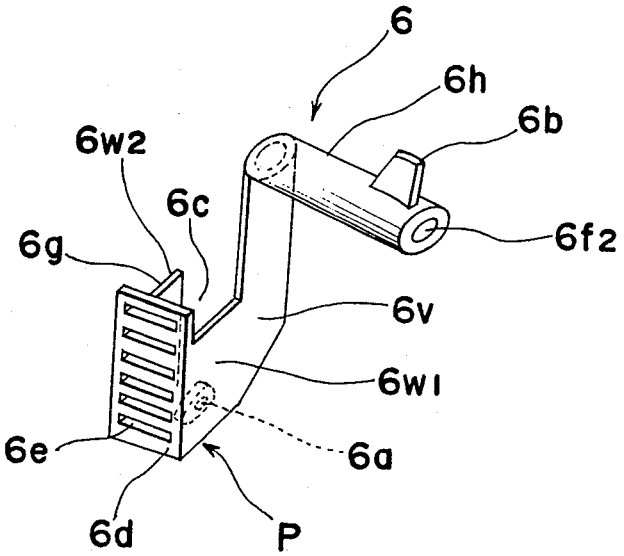
FIG. 6 is a perspective view of a lever arm with a protecting cover which may be employed in the discharge direction control device of FIGS. 1 through 5.

Referring further to FIGS. 5 and 6, there is shown in FIG. 6 a protecting cover portion P provided at the lower end of the vertical portion 6*v* of the lever arm 6. The protecting cover portion P includes opposite side walls 6*w*1 and 6*w*2, and a front wall 6*d* connected between front edges of the side walls 6*w*1 and 6*w*2 and formed with a large number of ventilating holes 6*e* therein for the protection of the SMA member 7 thereby. Since the opposite side walls 6*w*1 and 6*w*2 are in the form of flat plates to cover the SMA member 7, even when the direction of the air flow is altered laterally by the operation of the lateral discharge direction changing vanes 13 (FIGS. 1 and 5), the air flow is uniformly directed onto the SMA member 7 at all times without failing to impinge thereupon (FIG. 5). The rear side 6*c* of the protecting cover P defined by the side walls 6*w*1 and 6*w*2 and front wall 6*d* is opened to receive a stable amount of air flow caused by a blower 14 and passing through an air passage 12 within the indoor unit 1, while the front wall 6*d* is provided with the ventilating holes 6*e*, and thus the air flow introduced from the rear side 6*c* is not disturbed even after passing through the coil-like SMA member 7. Notched portions 6*g* are formed on the upper portions of the side walls 6*w*1 and 6*w*2 so that the lever arm 6 is not interfered with by the discharge direction changing blade 8 during the upward or downward movements thereof.

By the above arrangement, part of the air flow passing through the air flow passage 12 is introduced into the rear side 6*c* of the protecting cover P as shown in FIG. 5, and discharged from the ventilating holes 6*e* in the front wall 6*d* through the SMA member 7 in the form of a coil. In the above case, the coil-like SMA member 7 is subjected to expansion or contraction according to the temperature of the air flow so as to rotate the discharge direction changing blade 8 over the notched portions 6*g* for changing direction of the air flow.

As is clear from the foregoing description, in the discharge direction control device for an air conditioner according to the present invention, it is so arranged that the air flow discharge direction changing blade provided at the air blast opening of the air conditioner is adapted to be driven by the SMA member to be expanded or contracted according to temperatures, and moreover, that the automatic rotation and stopping at any desired position of the discharge direction changing blade can be achieved by releasing the lever arm from the contact thereof with the shaft of the discharge direction changing blade, and therefore, not only the convenience in operation has ben markedly improved, but the driving motor and temperature detecting means etc. conventionally required for the arrangements of this kind become unnecessary, with a consequent reduction in cost. Meanwhile, since the mechanism for fixing or releasing from fixing, the discharge direction changing blade is constituted by the notched portion formed in the bearing and the operating knob of the lever arm, the construction is simplified, thus resulting in less trouble and lower cost.

Moreover, by constituting the lever arm which supports one end of the SMA member, into the form of the protecting cover for covering the SMA member, said SMA member is advantageously protected against external forces, and furthermore, since the ventilating holes are formed in the protecting cover portion, ventilation with respect to the SMA member is stabilized, and thus, stable expansion and contraction of the SMA member can be achieved for an efficient and stable air flow discharge direction control.

It is to be noted here that the present invention is not limited in its application to the discharge direction control device for the indoor unit of the room air conditioner as described in the foregoing embodiment alone, but may readily be applied to air flow discharge control devices for air conditioners, air blowers and the like.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A discharge direction control device for an air conditioner, which comprises a discharge direction changing blade for controlling the discharge direction of air flow upwardly and downwardly, a shape memory alloy member for rotating the discharge direction changing blade in one direction, and a bias spring member for urging said discharge direction changing blade to rotate in the other direction which are provided at an air blast opening of the air conditioner arranged to blast heat-exchanged air therefrom, a lever arm member urged to contact a shaft at one end of said discharge direction changing blade, and a releasing mechanism for releasing said lever arm member from the contact thereof with said shaft.

2. A discharge direction control device as claimed in claim 1, wherein said releasing mechanism includes a bearing member axially, movably accommodating therein said lever arm member and provided with a notched portion in which an operating lever of said lever arm member is slidably movable, said notched portion being formed by an axially extending displacing portion and an engaging portion communicated with said displacing portion and extending in an outer peripheral direction of said bearing.

3. A discharge direction control device as claimed in claim 1, further including a protecting cover member formed with a large number of ventilating holes, and provided at the lee side of the shape memory alloy member for rotating said discharge direction changing blade.

4. A discharge direction control device as claimed in claim 3, wherein said protecting cover member is integrally formed with said lever arm member.

5. A discharge direction control device for a room air conditioner, which comprises a discharge direction changing blade for altering the discharge direction of air blast upwardly or downwardly, said discharge direction changing blade being pivotally supported, at opposite ends thereof, by lateral side walls of an air blast opening of the air conditioner arranged to blast heat-exchanged air therefrom, and a bias spring provided at one side of said side walls and functioning to maintain said discharge direction changing blade horizontal, the other side of said side walls for the air blast opening being provided with a lever arm urged by a spring member to contact an end portion of said discharge direction changing blade, a releasing mechanism for releasing said lever arm from its contact with said discharge direction changing blade, a shape memory alloy member which changes its shape so as to direct said discharge direction changing blade downwardly when the air blast from said air blast opening has a temperature above a predetermined temperature, and a protecting cover covering said shape memory alloy member and integrally formed with said lever arm, with a large number of ventilating holes being formed in said protecting cover.

* * * * *